US008089433B2

(12) United States Patent
Rumreich et al.

(10) Patent No.: US 8,089,433 B2
(45) Date of Patent: Jan. 3, 2012

(54) CONTRAST RATIO ENHANCEMENT SYSTEM USING BLACK DETECTOR

(75) Inventors: Mark Francis Rumreich, Indianapolis, IN (US); John Alan Hague, Indianapolis, IN (US)

(73) Assignee: TTE Technology, Inc., Indianapolis, IN (US)

( * ) Notice: Subject to any disclaimer, the term of this patent is extended or adjusted under 35 U.S.C. 154(b) by 771 days.

(21) Appl. No.: 12/160,057

(22) PCT Filed: Jan. 11, 2006

(86) PCT No.: PCT/US2006/000901

§ 371 (c)(1), (2), (4) Date: Jul. 3, 2008

(87) PCT Pub. No.: WO2007/081331

PCT Pub. Date: Jul. 19, 2007

(65) Prior Publication Data

US 2008/0303759 A1 Dec. 11, 2008

(51) Int. Cl.
*G09G 3/34* (2006.01)

(52) U.S. Cl. ..... 345/84; 345/102; 345/601; 345/89

(58) Field of Classification Search ..... 345/84, 345/102, 89

See application file for complete search history.

(56) References Cited

U.S. PATENT DOCUMENTS

| | | | | |
|---|---|---|---|---|
| 5,124,818 | A * | 6/1992 | Conner et al. | 349/75 |
| 5,442,467 | A | 8/1995 | Silverstein et al. | |
| 6,681,053 | B1 | 1/2004 | Zhu | |
| 6,791,607 | B1 | 9/2004 | Bilhan et al. | |
| 6,894,666 | B2 | 5/2005 | Otawara et al. | |
| 7,253,860 | B2 | 8/2007 | Chang | |
| 2005/0031201 | A1 | 2/2005 | Goh | |
| 2005/0062913 | A1 | 3/2005 | Choi et al. | |
| 2005/0104841 | A1 | 5/2005 | Sohn et al. | |
| 2005/0104842 | A1 * | 5/2005 | Baik | 345/102 |
| 2005/0125179 | A1 | 6/2005 | Selby et al. | |
| 2005/0156868 | A1 * | 7/2005 | Park et al. | 345/102 |
| 2008/0136768 | A1 * | 6/2008 | Chuang | 345/102 |
| 2008/0259091 | A1 * | 10/2008 | Rumreich et al. | 345/601 |

FOREIGN PATENT DOCUMENTS

| | | | |
|---|---|---|---|
| EP | 1522988 | A2 | 4/2005 |
| GB | 2337629 | A | 11/1999 |
| JP | 11073162 | | 3/1999 |
| JP | 2000314878 | A | 11/2000 |
| JP | 2001154638 | A | 8/2001 |
| TW | 594275 | | 6/2004 |

(Continued)

OTHER PUBLICATIONS

PCT International Search Report and the Written Opinion of the International Searching Authority, mailed Sep. 14, 2006.

(Continued)

*Primary Examiner* — Amare Mengistu
*Assistant Examiner* — Premal Patel
(74) *Attorney, Agent, or Firm* — Fletcher Yoder, P.C.

(57) ABSTRACT

The disclosed embodiments relate to a system and method of enhancing a contrast ratio of a display device. An exemplary method comprises determining a quantity of pixels in a frame of video data having a predetermined level of blackness, comparing the quantity of pixels to a reference value, and modulating an illumination signal based on a quantity of pixels exceeding the reference value.

20 Claims, 5 Drawing Sheets

FOREIGN PATENT DOCUMENTS

WO W02005/119639 A1 12/2005

OTHER PUBLICATIONS

Konno, A., et al, 40.2: RGB Color control System for LED Backlights in IPS-LCD TVs, SID 2005 Digest, pp. 1380-1383.

Matsumoto, S., et al, A Single-cell high-quality black and white ST liquid-crystal display, Electronic Devices, IEEE Transactions, vol. 36, Issue 9, Sep. 1989, pp. 19-5-1909 (abstract only available).

Matz, S. C., et al., A nonlinear technique for image contrast enhancement and sharpening, 1999, Proceedings of the 1999 IEEE International Symposium on Circuits and Systems, vol. 4, Jul. 1999, pp. 175-178 (abstract only available).

Raman, N., et al., Dynamic contrast enhancement of liquid crystal displays with backlight modulation, Consumer Electronics, 2005, ICCE, 2005 Digest of Technical Papers, International Conference, Jan. 8-12, 2005, pp. 197-198 (abstract only available).

* cited by examiner

CONTRAST RATIO ENHANCEMENT SYSTEM USING BLACK DETECTOR

CROSS-REFERENCE TO RELATED APPLICATIONS

This application is a National Phase 371 Application of PCT Application No. PCT/US06/00901, filed Jan. 11, 2006, entitled "CONTRAST RATIO ENHANCEMENT SYSTEM USING BLACK DETECTOR".

FIELD OF THE INVENTION

The present invention relates generally to display systems. More specifically, the present invention relates to a system and method for enhancing contrast ratio in certain display systems.

BACKGROUND OF THE INVENTION

This section is intended to introduce the reader to various aspects of art, which may be related to various aspects of the present invention that are described and/or claimed below. This discussion is believed to be helpful in providing the reader with background information to facilitate a better understanding of the various aspects of the present invention. Accordingly, it should be understood that these statements are to be read in this light, and not as admissions of prior art.

Liquid Crystal Displays (LCD) panels are increasingly being used for television display applications mainly due to their light weight and thin profile, as compared to Cathode Ray Tubes (CRTs). However, the performance of LCD panels is still lagging behind CRTs in a number of key areas, one of which is contrast ratio. As an example, the contrast ratio of high-end LCD panels is generally about 500:1, while for a CRT, 10,000:1 is a common ratio.

The contrast ratio may be defined as the ratio of the amount of light of the brightest white to the darkest black of a video frame. Unfortunately, due to their light transmitting properties, pixels of LCD panels transmit enough light, even when in their darkest state, such that a black colored pixel displayed on the LCD panel actually appears to be displayed as a dark gray pixel. Consequently, this significantly lowers the contrast ratio of the LCD panel, which may be more objectionable in low light viewing conditions.

Furthermore, in traditional contrast ratio enhancement systems, only statistical information regarding whitest areas of each video frame is obtained for modulating backlight illumination. However, using only white data while neglecting black data contained in the video frame can lead to undesired artifacts. Such artifacts may result from modulating an illumination signal in scenes containing few or no dark areas occupying the screen of a display device. As appreciated to those skilled in the art, this may lead video artifacts, such as pumping gray levels, pumping black levels, and white reduction.

SUMMARY OF THE INVENTION

Certain aspects commensurate in scope with the disclosed embodiments are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The disclosed embodiments relate to a system and method that enhance a contrast ratio of a display device, comprising determining a quantity of pixels in a frame of video data having a predetermined level of blackness, comparing the quantity of pixels to a reference value, and modulating an illumination signal based on a quantity of pixels exceeding the reference value. In addition to LCDs, the disclosed system and method may further apply to digital light displays (DLPs) and to liquid crystal on silicon (LCOS) display systems.

BRIEF DESCRIPTION OF THE DRAWINGS

Advantages of the invention may become apparent upon reading the following detailed description and upon reference to the drawings in which.

DETAILED DESCRIPTION

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
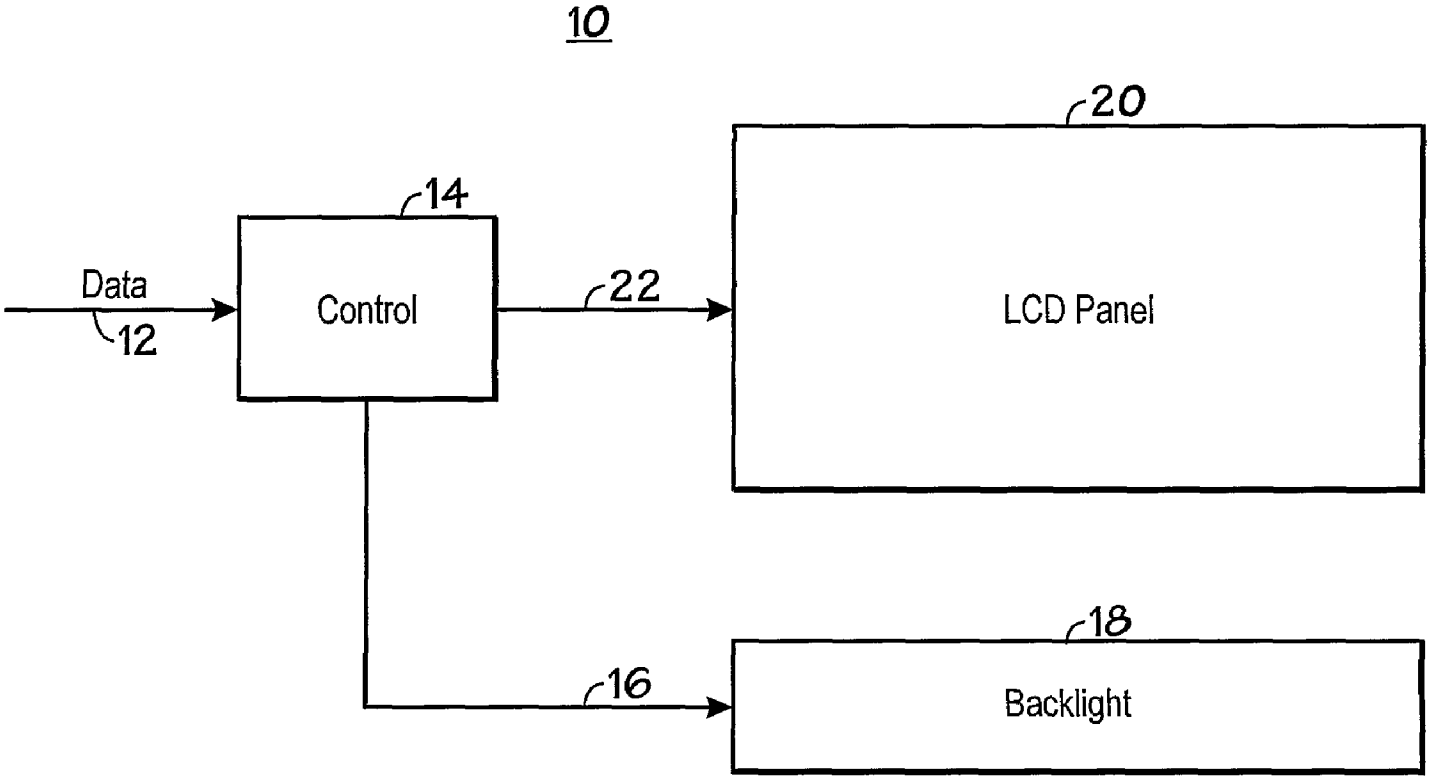
FIG. 1 is a block diagram of an LCD panel in accordance with an exemplary embodiment of the present invention.

Referring to FIG. 1, a configuration of an exemplary LCD panel system 10 in accordance with an embodiment of the present invention is shown. The figure depicts an LCD panel 20 and a backlight 18 controlled by a control system 14. The control system 14, receives data 12, which may include video backlight illumination and liquid crystal pixel data values. The control system 14 may use the data 12 to simultaneously adjust the backlight and the pixel values to enhance the contrast ratio of the LCD panel 20. Accordingly, data 22 outputted by the control system 14 goes into the LCD panel 20 for adjusting the pixel values. Similarly, data 16 outputted by the control system 14 is transmitted into the backlight 18 for adjusting the backlight illumination of the video.

Figure 2:
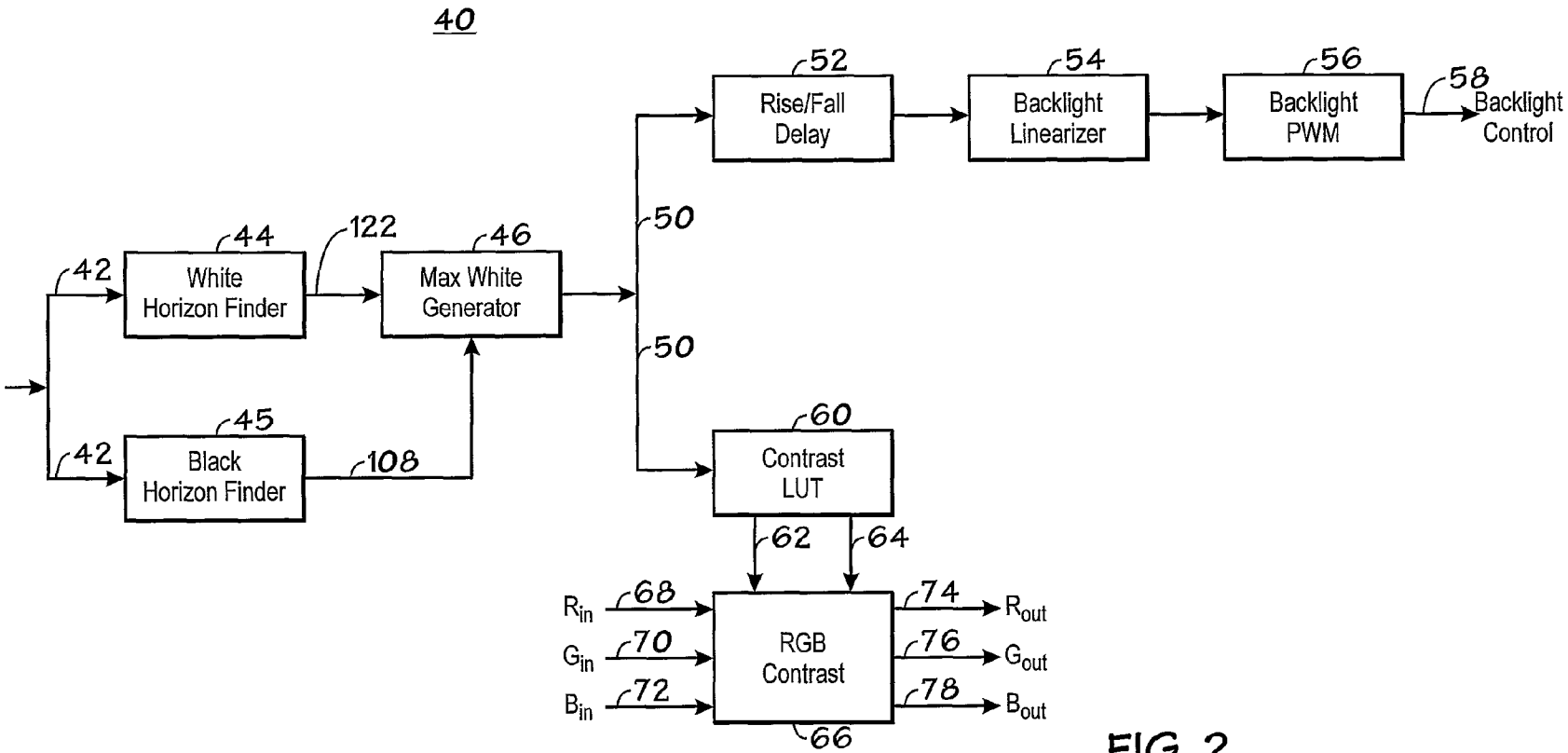
FIG. 2 is a block diagram of a contrast ratio enhancing system in accordance with an exemplary embodiment of the present invention.

Turning now to FIG. 2, a contrast ratio enhancement control system 40 in accordance with an exemplary embodiment of the present invention is shown. The description set forth of the control system 40 pertains to components controlling the video backlight illumination and the pixel values of the LCD panel 20. A white horizon finder 44 and a black horizon finder 45, as explained further below, receive respective luminance component data 42. The white horizon finder 44 and the black horizon finder 45 respectively determine statistical information relating to the brightness levels and blackness levels, as well as their distribution throughout a video frame. Information obtained by the white horizon finder 44 and the black horizon finder 45 is delivered to a maximum white generator 46. The maximum white generator 46 controls the backlight illumination and the liquid crystal pixel values. In an exemplary embodiment, backlight illumination and pixel values are controlled at the same time. In accordance with embodiments of the present invention, the two are adjusted in a complementary fashion to enhance the contrast ratio of the LCD panel 20.

The maximum white generator 46 controls the backlight illumination by determining the brightness of the brightest area of the video frame. This information is then utilized to determine the amount of backlight needed to illuminate the LCD panel 20, for example, as applied by cold-cathode-fluorescent (CCF) lamps. To improve the contrast ratio, a reduced backlight illumination is desired. However, reducing the backlight illumination too much may cause an undesired "white reduction" of the video frame. In order to avoid this, brightness information obtained by the maximum white generator 46 is further utilized to modify the pixel values of the LCD panel to compensate for possible insufficient backlight illumination.

The maximum white generator 46 produces data 50, which may be used to simultaneously adjust the backlight illumination data and red, green, and blue (RGB) input values of the LCD panel 20. The data 50 may be delivered to backlight control circuitry, which provides control data 58. Such backlight control circuitry may include: a rise/fall delay circuit 52, which compensates for time misalignments between the backlight illumination and the raster scanning of the pixels. This may prevent viewer perceived white flashes appearing on a screen, which are generally undesired. Also included in the backlight control circuitry are a backlight linearizer 54 which compensates for nonlinearity in the light characteristic of the backlight, and a backlight pulse width modulator (PWM) 56 which controls the illumination level of the backlight.

Further, to compensate for backlight illumination, maximum white data 50 is provided by the maximum white generator 46 for modifying the pixel values of the LCD panel 20 in a non-linear gamma-corrected domain. Accordingly, the data 50 is delivered to a contrast look-up table (CLUT) 60, which stores adjustment values that are formatted as an RGB offset 62 and an RGB gain-value 64. The RGB offset value 62 and the RGB gain-value 64 are delivered to an RGB contrast circuit 66. Accordingly, input RGB pixel values 68-72 are combined with the RGB offset 62 and the RGB gain-value 64 to yield gamma-corrected RGB pixel values 74-78.

The black horizon finder 45 acquires and quantifies statistical data of blackness or black and near-black levels in each a video frame. The maximum white generator 46 may acquire the statistical information to advantageously modulate the backlight illumination and enhance the contrast ratio of a display system 20. For example, in a video frame containing insignificant quantities of near-black levels, it may be more efficient and desirable not modulate the backlight illumination at all. To determine whether backlight modulation is warranted, the black horizon finder 45 analyzes the input data 42. Particularly, the black horizon finder 45 may use the data 42 to obtain the cumulative quantity of black pixels in every frame which fall below a certain blackness level. This cumulative quantity of pixels is then compared to a configurable threshold. Upon determining that the cumulative number of pixels exceeds the threshold, the backlight illumination is permitted to be modulated.

Figure 3:
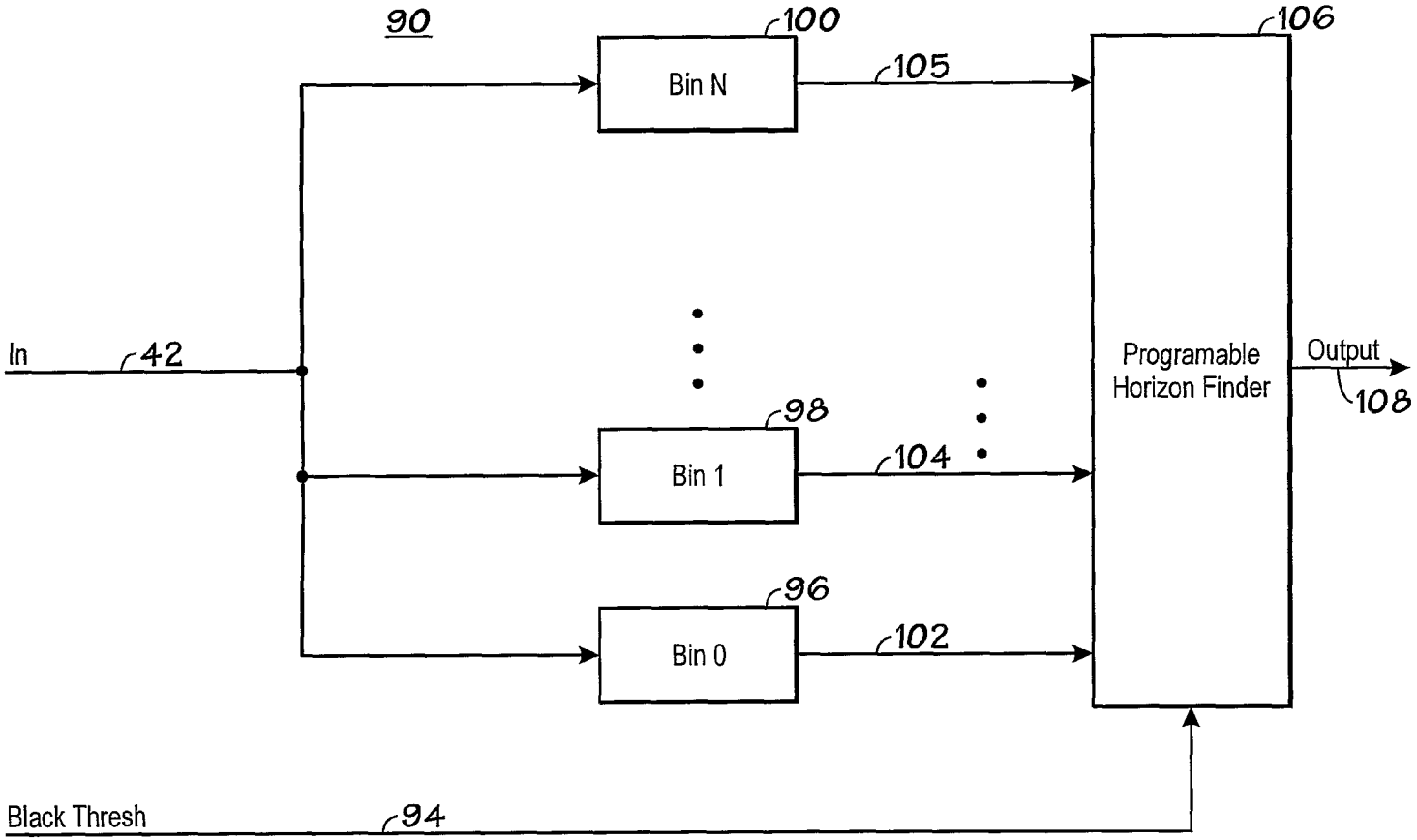
FIG. 3 is block diagram of black horizon finder in accordance with an exemplary embodiment of the present invention.

Referring to FIG. 3, a block diagram in accordance with an exemplary embodiment of the present technique is illustrated. The block diagram depicts a circuit 90 adapted to obtain statistical information of blackness levels in a video frame. In an exemplary embodiment, backlight illumination data 42 is delivered to an array of bins 96-100. Although three bins are shown in FIG. 3, other numbers of bins may be employed based on system design criteria. An exemplary embodiment of the present invention employs nine bins. The purpose of each of the bins 96-100 is to respectively count the number of pixels in each video frame that fall below a certain blackness level. Thus, in an exemplary embodiment, the bin 96 may include, for example, all pixels having values of shades of gray that are below 4. Similarly, bin 100 may include all pixels having values of shades of gray that are below 36. In this manner, a histogram of nine bins is obtained, where each bin total enumerates the number of pixels falling below a certain blackness level.

The bins 96-100 produce respective pixel count data 102-105, delivered to a programmable horizon finder 106. The purpose of the programmable horizon finder 106 is to compare each of the data inputs 102-105 to a configurable black threshold 94. Such a comparison may yield the bin number 96-100 having the quantity of black and near black pixels exceeding and/or matching the black threshold 94. Hence, knowing the threshold-matching bin number and its corresponding blackness level may determine the effective blackness area contained in the video frame. This information may further be used by the maximum white generator 46 to determine the degree of modulation needed for the backlight. Consequently, the programmable horizon finder 106 produces a data output 108 for each video frame quantifying the bin number closest to the threshold 94. In an exemplary embodiment, the resolution of the data output is six bits. Accordingly, an advantage of the system 90 is its ability to quantify black and near black levels of a video frame via sixty four states of resolution, while employing a significantly reduced number of hardware-implemented bins to classify the sixty four states of resolution. It is believed that the use of nine bins with six bit resolution provides an effective tradeoff between resolution and system complexity.

Figure 4:
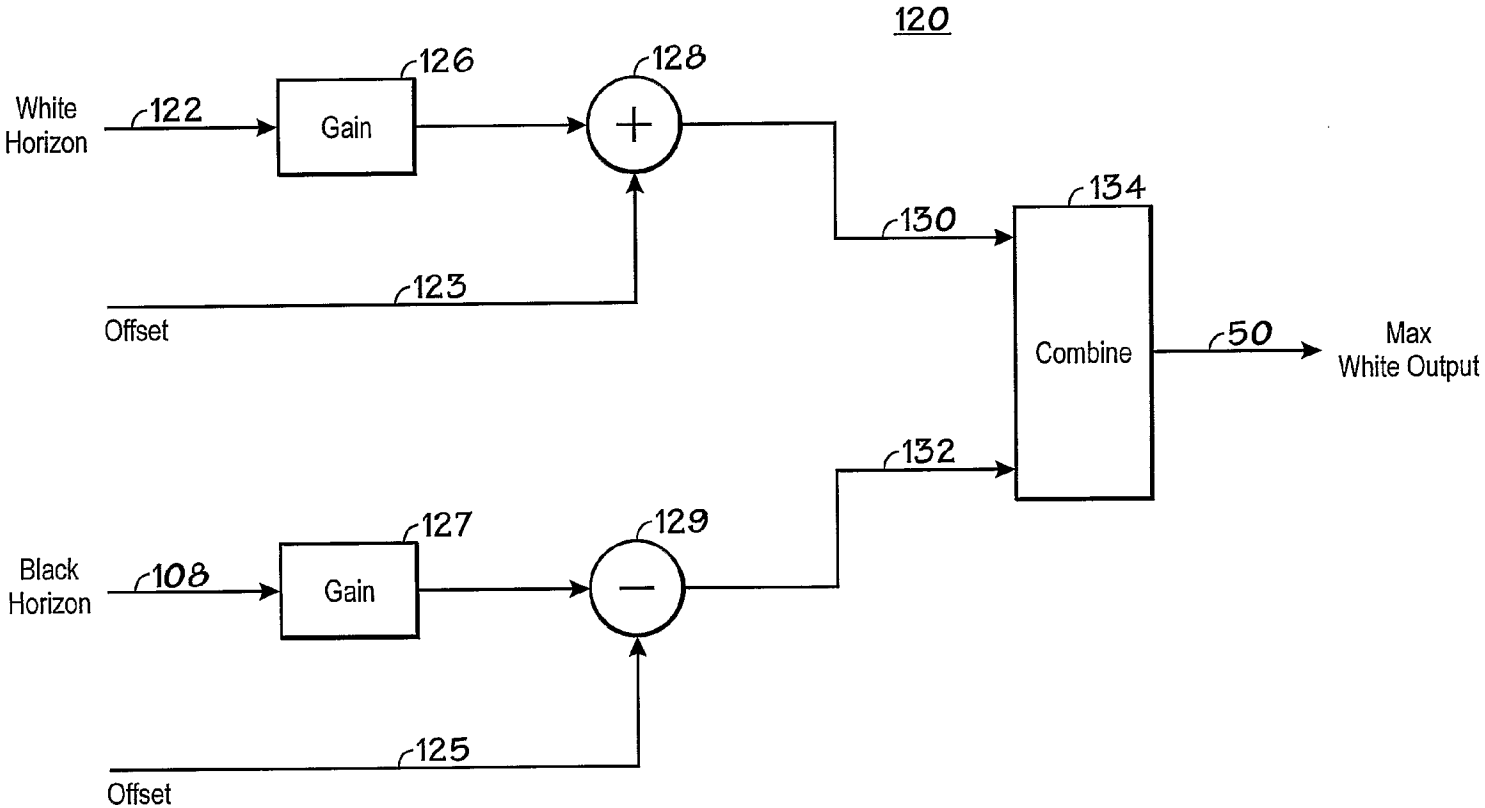
FIG. 4 is a block diagram of a maximum white generator in accordance with an exemplary embodiment of the present invention.

FIG. 4 is a block diagram of a circuit 120 in accordance with an exemplary embodiment of the present invention. The circuit 120 depicts components comprising the maximum white generator 46 for processing video illumination data. Accordingly, data 122 delivered from the white horizon finder 44, and data 108 produced by the programmable horizon finder 106 of the black horizon finder 45 are delivered to respective gain components 126 and 127. Thereafter, these are respectively processed by adder 128 and subtractor 129. The adder 128 and the subtractor 129 are further provided with offsets 123 and 125 respectively. Resultant data 130 and 132 are delivered into a combining circuit 134. In an exemplary embodiment, the combining circuit 134 may be configured to identify the maximum of the values 130 and 132. In a different exemplary embodiment, the combining circuit 134 may be configured to identify the minimum of the values 130 and 132. An exemplary implementation of the circuit 120 can be mathematically described by the following equation:

$$\text{max white}=\text{MAXIMUM}(128+2(\text{white horizon}),\ 255-2(\text{black horizon}))$$

The foregoing equation makes use of the white horizon data 122 provided by the white horizon finder 44, and of the black horizon data 108 provided by the black horizon finder 45.

Figure 5:
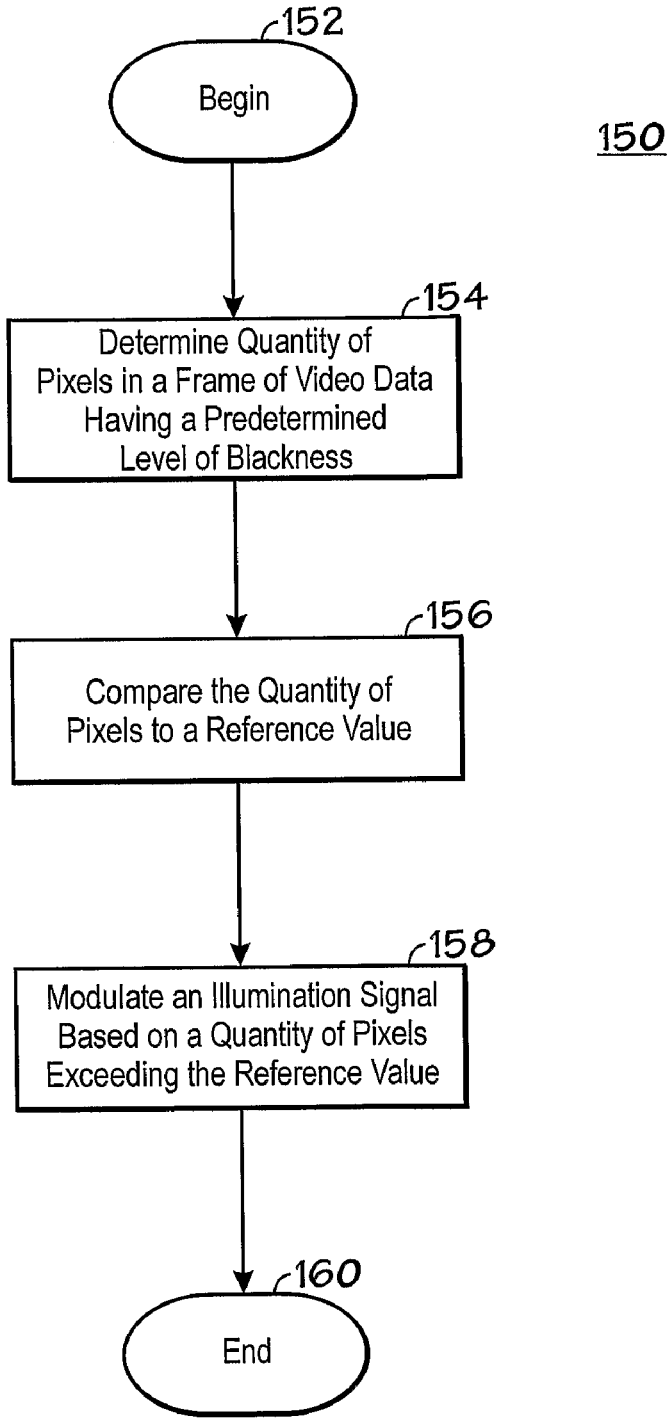
FIG. 5 is flow chart depicting a method for obtaining a required backlight illumination based on black areas of a video frame in accordance with an exemplary embodiment of the present invention.

FIG. 5 depicts a flow chart outlining a method in accordance with the present technique. The flow chart generally referred to by reference numeral 150 depicts processing steps in modulating backlight illumination using statistical information of blackness or black and near-black levels in a video frame. Accordingly, the method begins at block 152 where the data 42 is inputted into the black horizon finder 45. At block 154 the data 42 is used to determine a quantity of pixels in each video frame having a predetermined level of blackness or near-black levels. At block 156, this quantity is compared to a reference value. According to the number of pixels exceeding the reference value, an illumination signal is modulated at block 158. Finally, the method ends at block 160.

While the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A method of enhancing a contrast ratio of a display device, the method comprising:

determining a quantity of accumulated pixels having a pixel blackness value between zero and a predetermined level of blackness in a frame of video data;

comparing the quantity of accumulated pixels to a reference value that is indicative of a desired number of accumulated pixels that are in the frame of video data and that have pixel blackness values below the predetermined level of blackness; and modulating an illumination signal based on a quantity by which the quantity of accumulated pixels exceeds the reference value.

2. The method recited in claim 1, comprising categorizing a plurality of pixels that comprise the frame of video data according to their blackness.

3. The method recited in claim 2, comprising separating subsets of the plurality of pixels into bins based on their blackness.

4. The method recited in claim 3, wherein the plurality of pixels are separated into one of nine bins based on their blackness.

5. The method recited in claim 4, wherein each of the nine bins is associated with a level of blackness value defined by six bits on an eight-bit blackness level scale.

6. The method recited in claim 1, comprising scaling a signal corresponding to a level of blackness and whiteness of the frame of video data.

7. The method recited in claim 1, comprising comparing the quantity of accumulated pixels to a value that is related to a maximum whiteness in the frame of video data.

8. A video system, comprising:

a black horizon finder that is adapted to determine a quantity of accumulated pixels having a pixel blackness value between zero and a predetermined level of blackness in a frame of video data, and adapted to compare the quantity of accumulated pixels to a reference value that is indicative of a desired number of accumulated pixels that are in the frame of video data and that have pixel blackness values below the predetermined level of blackness; and an illumination source control that modulates an illumination signal of a display device if the quantity of accumulated pixels is greater than the reference value.

9. The system recited in claim 8, wherein the black horizon finder is adapted to categorize a plurality of pixels that comprise the frame of video data according to their blackness.

10. The system recited in claim 9, wherein subsets of the plurality of pixels are separated into bins based on their blackness.

11. The system recited in claim 10, wherein the plurality of pixels are separated into one of nine bins based on their blackness.

12. The system recited in claim 11, wherein each of the nine bins is associated with a level of blackness value defined by six bits on an eight-bit blackness level scale.

13. The system recited in claim 8, wherein the illumination source control is adapted to scale a signal corresponding to a level of blackness of the frame of video data to correspond with a level of whiteness of the frame of video data.

14. The system recited in claim 8, wherein the illumination source control is adapted to compare the quantity of accumulated pixels to a value that is related to a maximum whiteness in the frame of video data.

15. The system recited in claim 8, wherein data provided by the illumination source control is adapted to adjust color pixel values in a gamma corrected domain.

16. A system for enhancing a contrast ratio of a display device, comprising:

a control system, comprising:

means for determining a quantity of accumulated pixels having a pixel blackness value between zero and a predetermined level of blackness in a frame of video data;

means for comparing the quantity of accumulated pixels to a reference value that is indicative of a desired number of accumulated pixels that are in the frame of video data and that have pixel blackness values below the predetermined level of blackness; and means for modulating an illumination signal based on a quantity by which the quantity of accumulated pixels exceeds the reference value.

17. The system recited in claim 16, wherein the control system comprises means for categorizing a plurality of pixels that comprise the frame of video data according to their blackness.

18. The system recited in claim 17, wherein the control system comprises means for separating subsets of the plurality of pixels into bins based on their blackness.

19. The system recited in claim 18, wherein the control system comprises means for separating the plurality of pixels into one of nine bins based on their blackness.

20. The system recited in claim 19, wherein each of the nine bins is associated with a level of blackness value defined by six bits on an eight-bit blackness level scale.

* * * * *